US012680795B2

(12) United States Patent
Zapf

(10) Patent No.: US 12,680,795 B2
(45) Date of Patent: Jul. 14, 2026

(54) CARTRIDGE OF A FIREARM, CARTRIDGE CHAMBER, COMBINATION CONSISTING OF A LOCK AND CARTRIDGE CHAMBER OF SUCH A CARTRIDGE, AND FIREARM

(71) Applicant: ATC Performance GmbH, Tautenhain (DE)

(72) Inventor: Robert Zapf, Langenargen (DE)

(73) Assignee: ATC Performance GmbH, Tautenhain (DE)

( * ) Notice: Subject to any disclaimer, the term of this patent is extended or adjusted under 35 U.S.C. 154(b) by 0 days.

(21) Appl. No.: 18/700,974

(22) PCT Filed: Oct. 14, 2022

(86) PCT No.: PCT/EP2022/078671
§ 371 (c)(1),
(2) Date: Apr. 17, 2024

(87) PCT Pub. No.: WO2023/062197
PCT Pub. Date: Apr. 20, 2023

(65) Prior Publication Data

US 2024/0426584 A1 Dec. 26, 2024

(30) Foreign Application Priority Data

Oct. 14, 2021 (DE) ..... 10 2021 006 113.6

(51) Int. Cl.
*F42B 5/02* (2006.01)
*F41A 21/12* (2006.01)

(52) U.S. Cl.
CPC ..... *F42B 5/025* (2013.01); *F41A 21/12* (2013.01)

(58) Field of Classification Search
CPC .... F42B 5/025; F42B 5/02; F42B 5/00; F42B 5/26; F42B 5/28; F42B 5/34; F41A 21/12
(Continued)

(56) References Cited

U.S. PATENT DOCUMENTS

2011/0214583 A1* 9/2011 Dutch ..... F42B 5/26 102/464
2014/0223789 A1* 8/2014 Kramer ..... F24B 5/025 42/25
2019/0204051 A1* 7/2019 Franklin ..... F42B 5/025

FOREIGN PATENT DOCUMENTS

WO 2016134393 A1 9/2016

OTHER PUBLICATIONS https://bulletin.accurateshooter.com/2015/11/wildcat-with-almost-no-neck-stan-wares-wicked-wolfpup/ Nov. 25, 2015.*
(Continued)

*Primary Examiner* — John Cooper
(74) *Attorney, Agent, or Firm* — COZEN O'CONNOR

(57) ABSTRACT

The invention relates to a cartridge of a firearm, comprising a cartridge case implemented in the manner of a bottleneck case for receiving a projectile, wherein the cartridge case has an overall length (L3) of 37.50 mm (1.4764") to 40.50 mm (1.5945"), preferably of 38.50 mm (1.5157") to 39.50 mm (1.5551"), particularly preferably of 39.00 mm (1.5354"), and the length of the case neck—case neck length (L3-L2)—is selected such that the ratio of the diameter (G1) of the projectile (8) to the case neck length (L3-L2) of the cartridge case is between 1.19 and 1.36, preferably between 1.26 and 1.36, and particularly preferably between 1.26 and 1.27.
The invention further relates to a cartridge chamber, to a combination of breech and cartridge chamber of such a firearm, and to a firearm.

20 Claims, 6 Drawing Sheets

Figure 1:
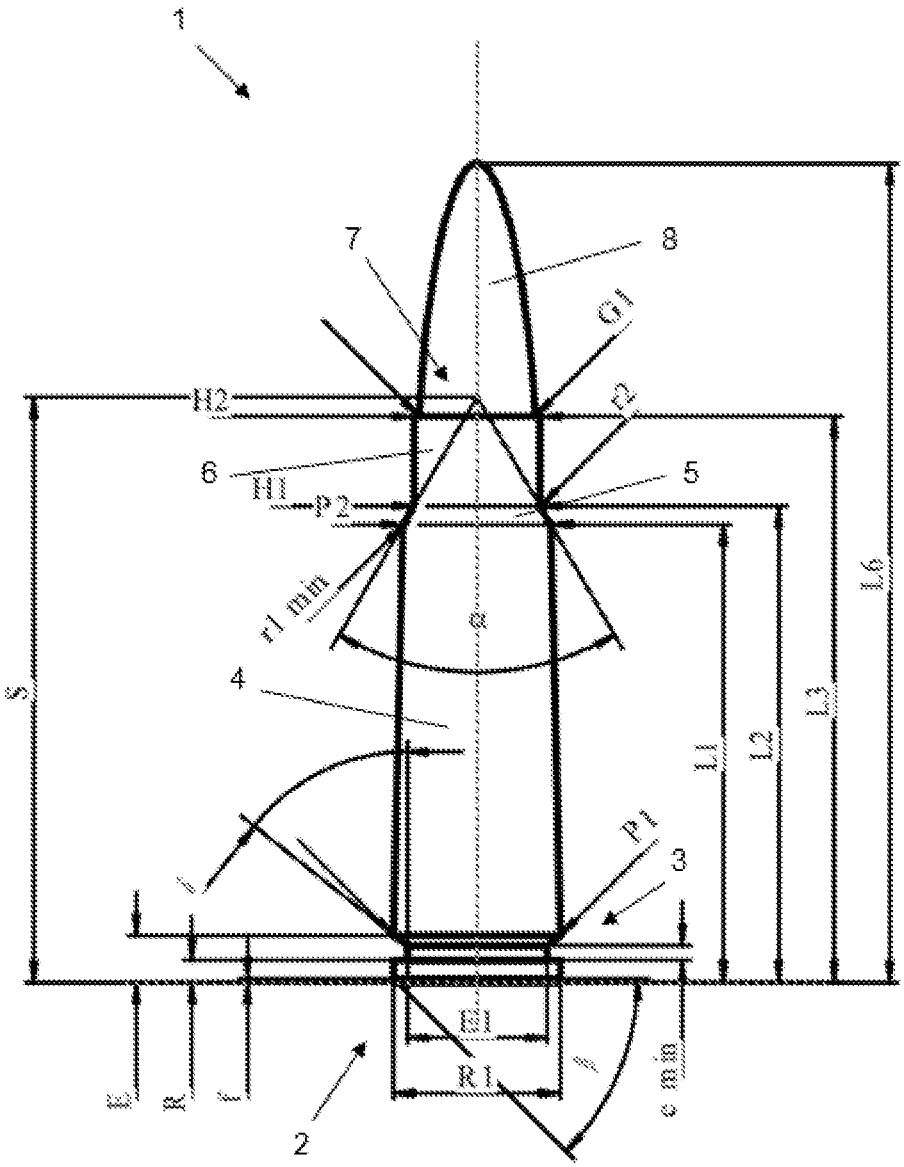

(58) Field of Classification Search
USPC ..... 102/464; 42/76.01
See application file for complete search history.

(56) References Cited

OTHER PUBLICATIONS https://bulletin.accurateshooter.com/2007/04/radical-wolf-pup-case-for-hunter-br/ Apr. 9, 2007.*
International Application No. PCT/EP2022/078671, "International Search Report", mailed Feb. 14, 2023, 4 pages.

* cited by examiner

CARTRIDGE OF A FIREARM, CARTRIDGE CHAMBER, COMBINATION CONSISTING OF A LOCK AND CARTRIDGE CHAMBER OF SUCH A CARTRIDGE, AND FIREARM

This application is a national stage of PCT/EP2022/078671, filed on Oct. 14, 2022, which claims priority to DE App. No. 10 2021 006 113.6, filed on Oct. 14, 2021, the entirety of which is incorporated herein by reference.

The invention relates to a cartridge of a firearm, to a cartridge chamber, to a combination of a breech and a cartridge chamber of such a firearm, and to a firearm, specifically according to the independent claims.

The invention relates to a novel cartridge, particularly an intermediate rifle cartridge or particularly a rimless rifle cartridge having a centerfire primer, specially conceived and optimized for handguns and support weapons for military and police operations in an urban environment, and for using subsonic and supersonic ammunition. Intermediate rifle cartridges have dimensions between those of cartridges for pistols and cartridges for rifles, enabling the discharge of controllable single and automatic fire from handguns while having sufficient range and projectile energy for the purpose. The engineering design had the objective of achieving maximum potential internal and external ballistic performance parameters.

One of the well-known, most reliable up to now, and most tried and tested designs for combat in an urban environment is the 7.62 mm×39 (M43) cartridge with the associated handgun systems. The most well-known handgun systems for firing said cartridge include the Automat Kalashnikov 47 assault rifle (AK-47).

The AK-47 system with 7.62 mm×39 (M43) caliber has presented the greatest potential threat to western states and NATO for over 75 years. Reasons for this include global spread, low purchase price, and the relatively small external dimensions and the low weight of the weapon system and cartridge, resulting in comparatively low shooter fatigue. The effectiveness of said cartridge can be considered sufficient for the application scenarios indicated above. The 7.62 mm×39 (M43) cartridge is a design presented in 1943 in the USSR, having been developed in the 1930s in Germany (Genschow company, Karlsruhe-Berlin) for the M35 assault rifle system from the Vollmer company in Biberach.

Military small arms of 7.62 mm×51 caliber can also fire projectiles in the subsonic and supersonic range. Said weapons, however, are suitable at most as support weapons in conjunction with highly dynamic operational tactics, due to the significantly higher weight of small arms and munitions.

In comparison with weapons systems for short cartridges (e.g., AK-47), the longer breech time (duration of automatic loading), in combination with greater shooter fatigue due to the more severe recoil characteristic, impedes rapid and precise shot sequences.

Finally, the interior volume of the case of the 7.62 mm×51 caliber is not optimally designed for subsonic ammunition, due to the relatively large cartridge case, potentially leading to mechanical problems with the weapon and loss of precision.

The object of the present invention is therefore to disclose a cartridge of a firearm able to eliminate the user-oriented gap in capability, particularly for operations in an urban environment, between the known 7.62 mm×39 (M43) and 7.62 mm×51 cartridges on the basis of an intermediate rifle cartridge. Superiority in the supersonic range relative to all comparable cartridges relevant to military and police (such as 5.56 mm×45 and 7.62 mm×35 cartridges) under otherwise identical conditions can thus be produced at typical combat range in an urban environment. In particular, a cartridge chamber, a combination of a breech and cartridge chamber of such a firearm, and a firearm capable of firing the cartridge according to the invention are disclosed, and unilateral backward compatibility with cartridges of caliber 7.62 mm×39 (M43) is also ensured.

The (length) data according to the present invention is presented in millimeters [mm] and in inches ["] in parentheses.

The object is achieved by an inventive cartridge of a firearm, comprising a cartridge case implemented in the manner of a bottleneck case for receiving a projectile, wherein the cartridge case has an overall length (L3) between 37.50 mm (1.4764") and 40.50 mm (1.5945"), preferably between 38.50 mm (1.5157") and 39.50 mm (1.5551"), particularly preferably 39.00 mm (1.5354"), and the length of the case neck of the cartridge—case neck length (L3-L2)—is selected such that the ratio of the diameter (G1) of the projectile (8) to the case neck length (L3-L2) of the cartridge case is between 1.19 and 1.36, preferably between 1.26 and 1.36, and particularly preferably between 1.26 and 1.27. Said ratio is thus a quotient of the projectile diameter (G1) and the case neck length (L3-L2).

The case neck length is the difference between the value L3 (overall length of the cartridge case) and the value L2 (length of the case up to the transition from shoulder to neck).

The length of the case neck, that is, the case neck length (L3-L2) may thereby be between 5.81 mm (0.2287") and 6.61 mm (0.2602").

The average maximum permissible gas pressure (Pmax) for the Commission Internationale Permanente (C.I.P.) is defined as up to 4400 bar (638176 psi), representing the maximum value according to C.I.P. The average maximum permissible gas pressure (Pmax) for the Sporting Arms and Ammunition Manufacturer's Institute (SAAMI) field is defined as 5515 bar (80000 psi). Said high gas pressures lead to a substantial increase in the ballistic power and the thermal efficiency in comparison with existing intermediate rifle cartridges.

The cartridge according to the invention may be a rimless rifle cartridge having a centerfire primer. Said cartridge comprises a case bottom having an extractor groove, and a case body connected thereto, wherein the case body transitions via a shoulder cone into a case neck for receiving the projectile.

When reference is made to dimensions according to the invention, such as L1, L2, L3, G1 of the cartridge or of the cartridge chamber, etc., or to known cartridges, then dimensions, sizes, tolerances, measuring runs, and terms used according to the typical rules of the aforementioned Permanent International Commission for the Proof of Small Arms (C.I.P.) are meant. The angle of the shoulder cone is typically indicated according to the present invention as a half angle, as per the Sporting Arms and Ammunition Manufacturer's Institute (SAMMI). In the figures (FIG. 5 and FIG. 6), the angle of the shoulder cone is depicted according to C.I.P.

The cartridge according to the invention may thereby:

be fired from preferably compact military small arms and support weapons having relatively short barrels, without excessive loss of performance and under low wear of the weapon system, be superior to comparable intermediate rifle cartridges, such as 7.62 mm×35 and 7.62 mm×39 (M43) cartridges in terms of ballistic effectiveness (precision, range, and energy transfer), be suitable for firing the heaviest projectiles of the caliber group in the subsonic range and contribute to a substantially lower unmasking factor in conjunction with the use of a silencer, be designed with respect to the special geometry of the cartridge chamber such that cartridges of caliber 7.62 mm×39 (M43) may also be fired (backward compatibility). The projectiles can be provided with comparatively high, above-average precision due to the optimal design of the projectile transition.

be designed with respect to the geometry of the cartridge according to the invention such that said cartridge cannot be fired from weapon systems of caliber 7.62 mm×39 (M43) (unilateral backward compatibility).

The cartridge length L6 is preferably between 55.00 mm (2.165") and 57.00 mm (2.244"), preferably between 55.70 mm (2.1929") and 56.30 mm (2.2165"), particularly preferably 56.00 mm (2.2047"). The cartridge chamber according to the invention ensures that cartridges of caliber 7.62 mm×39 (M43) can be fired in addition to the cartridge according to the invention and the projectiles can be fired with above-average high precision. The high precision capability is achieved by a projectile transition of the cartridge chamber designed for greater precision from a current perspective.

The diameter of the projectile is advantageously between 7.85 mm (0.309") and 7.92 mm (0.312"), preferably exactly 7.92 mm (0.312"), and the diameter (H1) of the case neck is preferably 8.60 mm (0.3386").

The length L2 from the bottom to the transition from shoulder cone to case neck may preferably be between 31.69 mm (1.2476") and 33.89 mm (1.3343"), preferably between 32.29 mm (1.2713") and 33.29 mm (1.3106"), particularly preferably 32.79 mm (1.2909").

A shoulder cone may preferably be connected to the case neck and in turn transition into a case body of the cartridge case, wherein the case body connects to an extractor groove of the cartridge at the case bottom and is preferably implemented having a conical taper in the direction from the extractor groove toward the shoulder cone, such that the case body has a diameter (P1) of 11.35 mm (0.4469") at the connection to the extractor groove and a diameter (P2) between 10.07 mm (0.3965") and 11.350 mm (0.4469"), preferably between 10.45 mm (0.4114") and 11.00 mm (0.4331"), particularly preferably 10.773 mm (0.4241") at the connection to the shoulder cone.

Said feature also achieves unilateral backward compatibility with the 7.62 mm×39 (M43) cartridge. Such a cartridge can thereby also be fired in a cartridge chamber provided for the cartridge according to the invention or in a firearm comprising such a cartridge chamber.

The preferred diameter P2 of 10.773 mm (0.4241") results in an approximately 7% greater case volume than that of the 7.62 mm×39 (M43) cartridge.

The cartridge comprises a primer. Said primer is preferably a Boxer centerfire primer or Berdan primer.

According to one embodiment of the cartridge, a radius of 1.50 mm (0.0591") is provided at the transition from the case body to the shoulder cone ($r1_{min}$) and a radius (r2) of 1.50 mm (0.0591") is provided at the transition from the shoulder cone to the case neck.

The shoulder cone can be implemented having a conical taper toward the case neck and comprises a half angle of 20° to 42.5°, preferably between 20° and 30°, particularly preferably 25°.

The present invention further relates to a cartridge chamber of a firearm, wherein the cartridge chamber has a cartridge space comprising a case neck to which a shoulder cone connects and in turn transitions into the case body, wherein the cartridge chamber is implemented complementarily for receiving the 7.62 mm×39 (M43) cartridge in addition to the cartridge according to the invention.

The ratio according to the invention of the projectile diameter G1 to the case neck length (L3-L2) of the cartridge may also be used with respect to the cartridge chamber implemented as a complement to the cartridge: here the difference is taken between the length L3, that is, the length of the cartridge chamber up to the diameter H2, and the length L2, that is, the length of the cartridge chamber up to the diameter H1. Said difference between L3 and L2 may thereby be selected such that the ratio of the diameter of the projectile transition (G1; diameter at the start of the transition of the rifling of the cartridge chamber) to said difference L3-L2 is between 1.13 and 1.27, preferably 1.19. The length L3 of the cartridge chamber up to the diameter H2 may thereby be between 37.80 mm (1.4882") and 40.80 mm (1.6063"), preferably between 38.50 mm (1.5157") and 40.00 mm (1.5748"), preferably between 39.00 mm (1.5354") and 39.50 mm (1.5551"), particularly preferably 39.30 mm (1.5472"), and the diameter G1 of the projectile transition may be 7.95 mm (0.313"). Said ratio leads to the advantages according to the invention already described with respect to the cartridge.

The cartridge chamber is thereby implemented having shoulder contact, so that the shoulder cone of the cartridge according to the invention in the cartridge chamber contacts the complementary shoulder cone of the cartridge chamber.

The diameter (H1) of the case neck may be 8.64 mm (0.3402"), and the cartridge chamber may preferably have a radius ($r1_{max}$) of 1.00 mm (0.0394") at the transition from the case body to the shoulder cone ($\alpha$) and a radius (r2) of 2.00 mm (0.0787") at the transition from the shoulder cone to the case neck. In combination with the further design features of the cartridge chamber, as described above with respect to the corresponding radii of the shoulder cone on the cartridge, not only the cartridge according to the invention but also cartridges of caliber 7.62 mm×39 (M43) can be fired by means of the cartridge chamber according to the invention.

The invention further relates to a combination of a breech and a cartridge chamber of a firearm, comprising a cartridge chamber according to the invention, wherein the cartridge chamber is implemented complementarily such that the maximum breech clearance (Fe), that is, the spacing between the casebottom of the cartridge and the closed breech of the firearm, is between 0.00 mm (0.00") and 0.15 mm (0.006") for a cartridge implemented according to the invention and introduced into the cartridge chamber. The breech clearance may thus be 0.10 mm (0.004") for the cartridge according to the invention and 0.15 mm (0.006") for the cartridge of caliber 7.62 mm×39 (M43).

The present invention further relates to a firearm comprising a cartridge chamber according to the invention or a combination according to the invention of breech and cartridge chamber. The firearm may thereby be a handgun, a small arm, such as a sidearm, a submachine gun, or a machine gun.

The invention, together with the description of a preferred embodiment example, is depicted in greater detail below using the figures.

Figure 2:
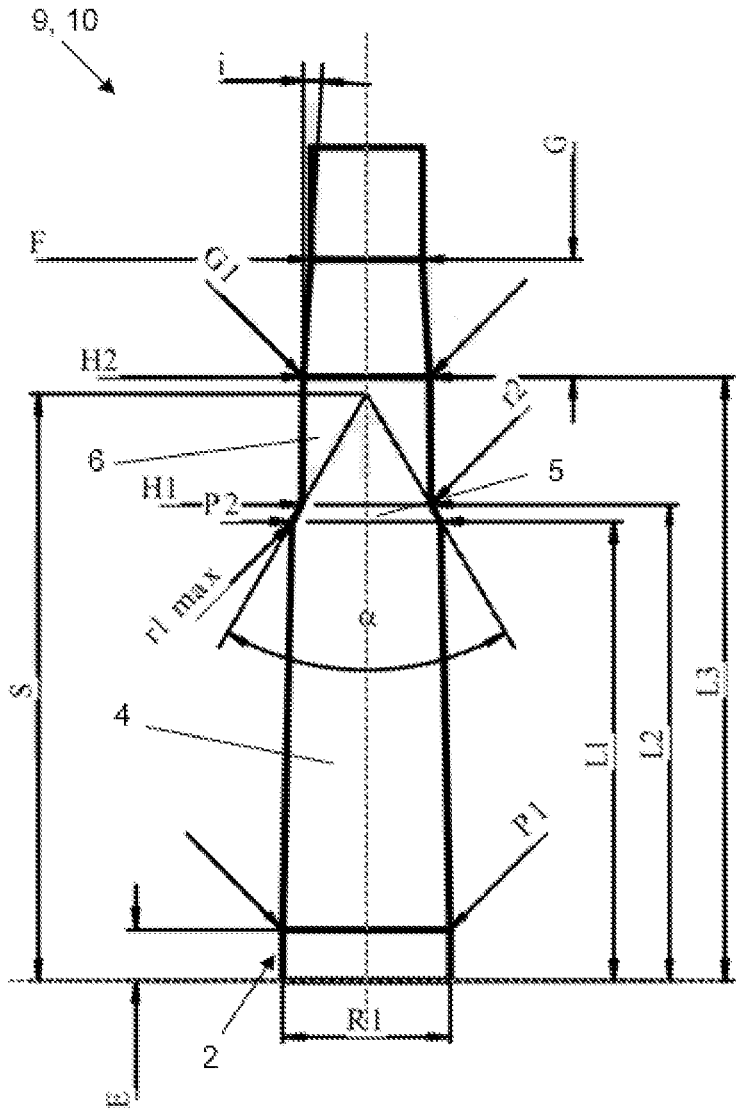
Figure 3:
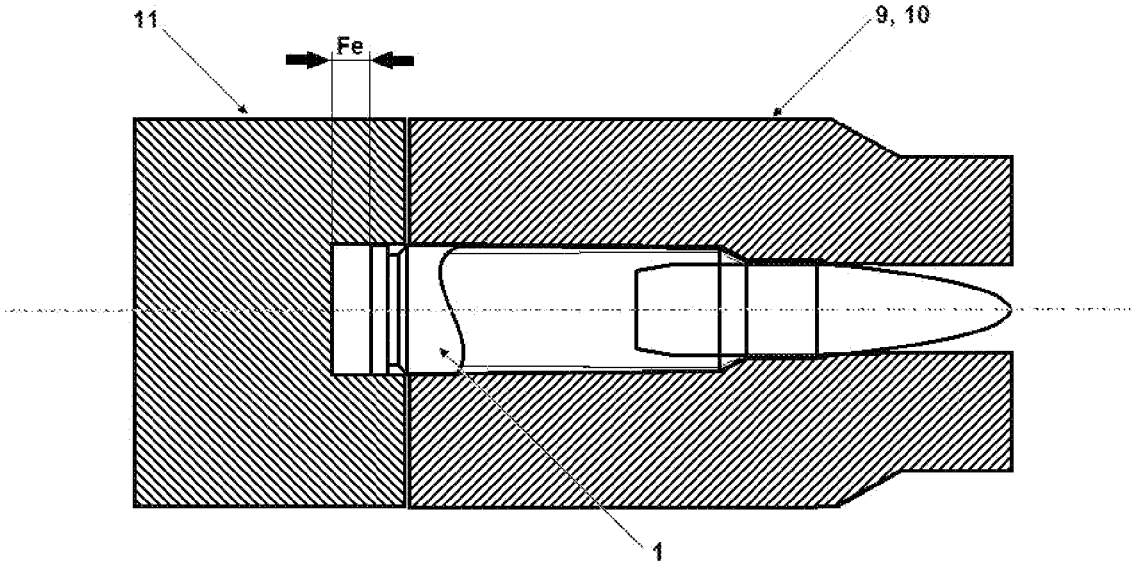
Figure 4:
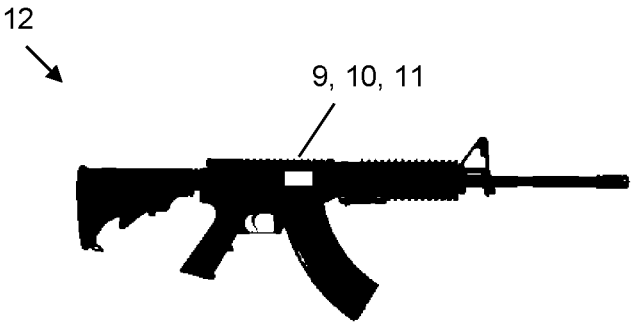
Figure 5:
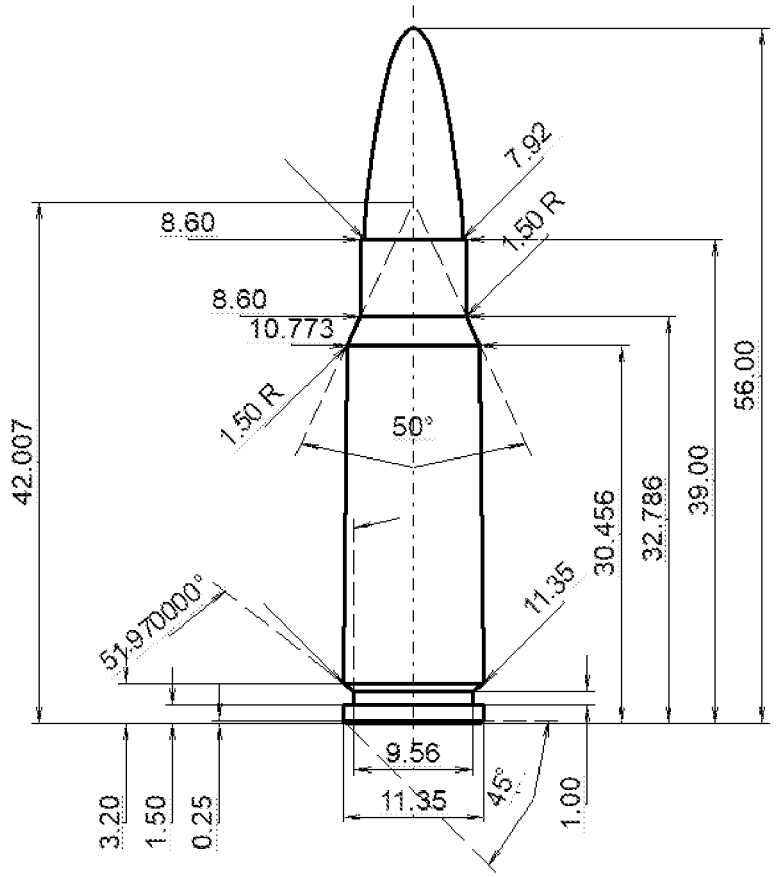
Figure 6:
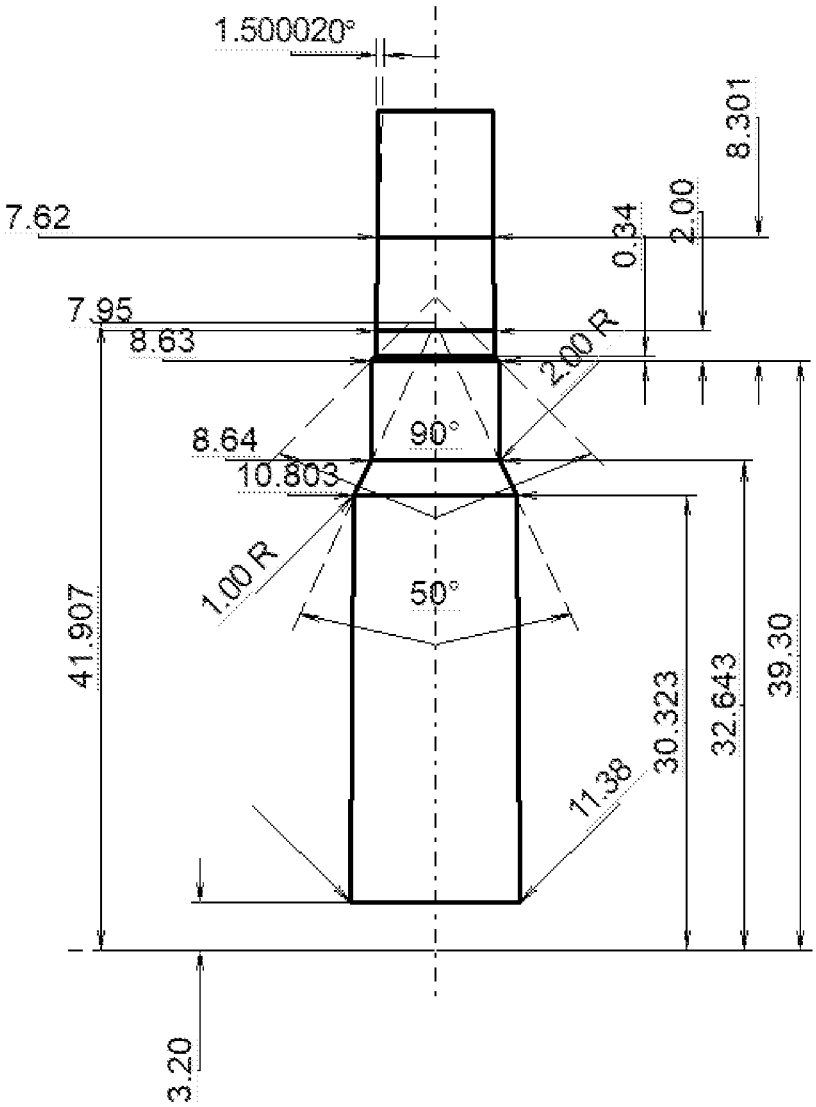
Figure 7:
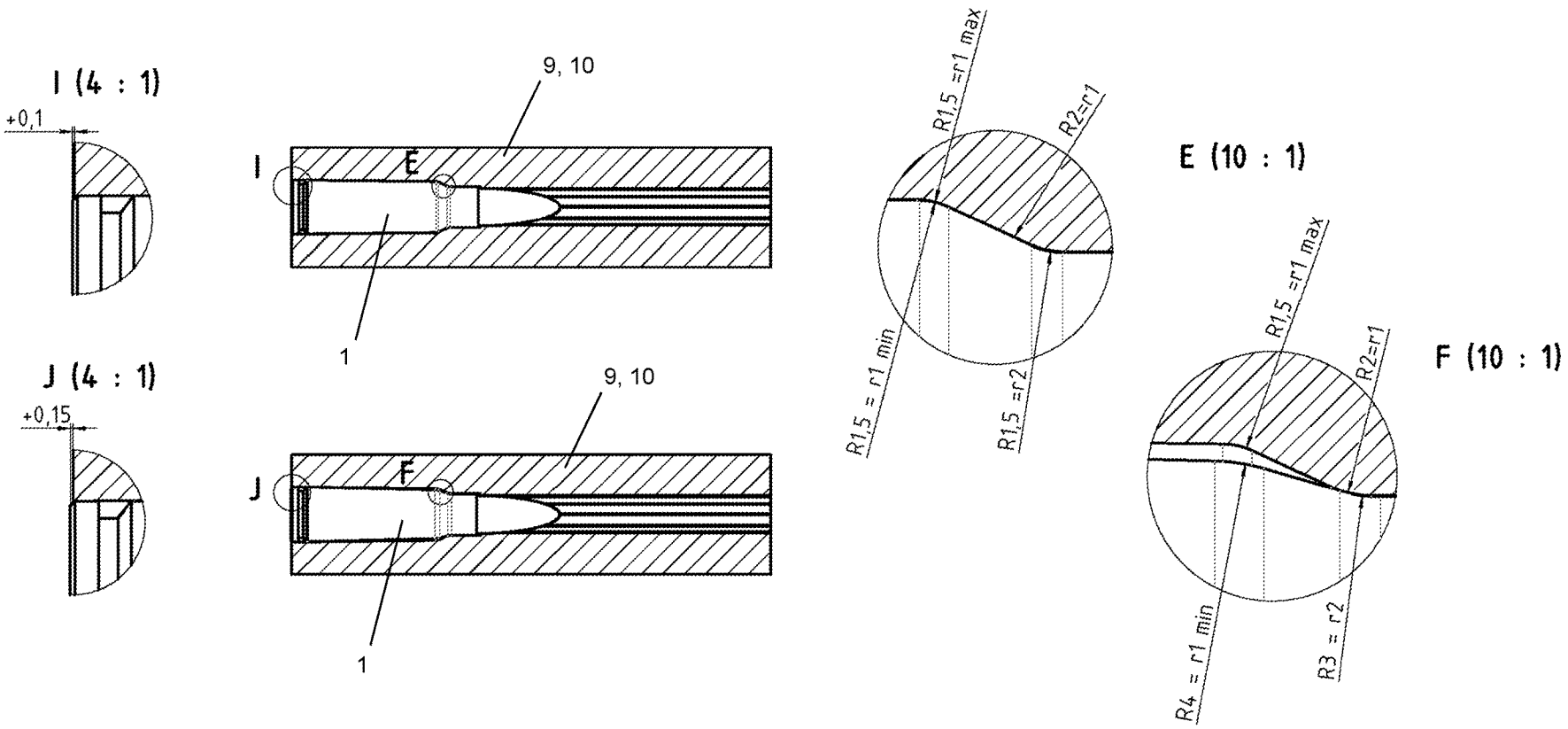

Shown are:

FIG. 1 an embodiment of the cartridge according to the invention;

FIG. 2 an embodiment of the cartridge chamber according to the invention;

FIG. 3 a section view of the cartridge according to the invention inserted in the cartridge chamber according to the invention with the breech closed;

FIG. 4 a schematic depiction of a potential firearm according to the invention;

FIG. 5 the dimensions of a preferred embodiment of the cartridge according to the invention;

FIG. 6 the dimensions of a preferred embodiment of the cartridge chamber according to the invention;

FIG. 7 a technical section view of a cartridge according to the invention inserted in the cartridge chamber according to the invention (top of drawing) and a cartridge of caliber 7.62×39 (M43) (bottom of drawing).

FIG. 1 shows an embodiment of the cartridge 1 according to the invention. The cartridge 1 according to the invention is implemented in the manner of a bottleneck case, such as a rimless rifle cartridge having a centerfire primer, and comprises a case bottom 2 having an extractor groove 3, a case body 4 connected thereto for receiving the propellant, wherein the case body 4 transitions via a shoulder cone 5 into a case neck 6, the case mouth 7 of which receiving a projectile 8. As is evident, the case body is tapered conically in the direction toward the projectile 8. The same applies to the shoulder cone 5.

One potential, preferred embodiment (best practice embodiment) of the cartridge according to the invention (maximum dimensions), as shown in FIG. 5 (dimensions in mm), may look as follows:

The case length to the shoulder (L1) is defined as 30.456 mm (1.199"). The case length to the shoulder/neck transition (L2) is 32.786 mm (1.291"). The overall case length (L3) is 39.00 mm (1.535") and the maximum cartridge length (L6) is 56.00 mm (2.205").

The dimensions of the case bottom are defined as follows: The rim height (R) is 1.50 mm (0.059"). The rim diameter (R1) is 11.35 mm (0.447"). The case bottom height (E) is 3.20 mm (0.126"). The diameter of the extractor groove (E1) is 9.56 mm (0.376"). The height of the extractor groove (e min) is 1.00 mm (0.039"). The bevel angle of the extractor groove (δ) is 51'58'12". The length of the rim bevel (f) is 0.25 mm (0.010"). The bevel angle on the rim (β) is 45°.

The dimension of the powder chamber diameter at the transition from case body to extractor groove (P1) is 11.35 mm (0.447") and the diameter at the transition from shoulder cone to case neck (P2) is 10.773 mm (0.424").

The dimensions of the shoulder cone are defined as follows: The shoulder angle (α) has a half angle of 25°. The length to the apex of the shoulder angle (S) is 42.007 mm (1.654"). A radius ($r1_{min}$) of 1.50 mm (0.059") is provided at the transition from the case body to the shoulder cone and a radius (r2) of 1.50 mm (0.059") is provided at the transition from the shoulder cone to the case neck.

Setting the dimensions of the case in the range of functional design limits enables a maximal volume of propellant powder, lower powder column, more uniform combustion of the propellant powder, and thus maximally designed internal and external ballistic performance.

Said design also has a positive influence on the variation in muzzle velocity $v_0$, in turn having a positive effect on precision in the supersonic and subsonic ranges. The more uniform and better combustion of the propellant powder is greatly significant, particularly for firearms having a silencer, because the design of said firearms leads to a significantly greater tendency toward contamination than firearms without silencers, in turn having a great effect on the reliability of the firearm. The design of the case shoulder also results in additional lengthening of the case neck length (L3-L2).

The diameter of the case neck at the shoulder/neck transition (H1) and at the case mouth (H2) is 8.60 mm (0.339") in each case.

The projectile diameter at the case mouth (G1) is 7.92 mm (0.312"). The length to the land caliber (L3+G) is 47.30 mm (1.862"). FIG. 2 shows an embodiment of the cartridge chamber 10, implemented complementarily to the cartridge 1 shown in FIG. 1 and having shoulder contact.

One potential, preferred embodiment (best practice embodiment) of the cartridge chamber according to the invention (minimum dimensions), as shown in FIG. 6 (dimensions in mm), may look as follows:

The length (L1) of the cartridge chamber up to the diameter P2 is 30.323 mm (1.194"). The length (L2) of the cartridge chamber up to the diameter H1 is 32.643 mm (1.285"). The length (L3) of the cartridge chamber up to the diameter H2 is defined as 39.30 mm (1.547").

The distance from the breech block to the inlet of the cartridge chamber (E) is 3.20 mm (0.126"). The diameter at the inlet of the cartridge chamber or at the distance E (P1) is 11.38 mm (0.448"). The diameter at the start of the shoulder cone at distance L1 (P2) is 10.803 mm (0.425").

The half angle of the shoulder cone (α) is 25 degrees. The length to the apex of the shoulder cone (S) is 41.907 mm (1.65"). The radius of the transition at the end of diameter P2 (r1 max) is 1.00 mm (0.039"), and at the transition from the shoulder cone to the case neck (r2) the radius is 2.00 mm (0.0787").

Said radii of the cartridge chamber ($r1_{max}$ and r2) are specially designed so that maximum reliability is ensured, depending on the different radii ($r1_{max}$ and r2) of each of the cartridges. When the 7.62 mm×39 (M43) cartridge is fired from the cartridge chamber according to the invention, the precisely defined breech clearance, in addition to the other design features, is formed by the radii r2 of each of the cartridges (cartridge according to the invention and 7.62 mm×39 (M43) cartridge) and of the cartridge chamber according to the invention.

The diameter at the start of the shoulder cone at distance L2 (H1) is 8.64 mm (0.34"). The diameter at distance L3 (H2) is 8.63 mm (0.34").

The diameter at the start of the transition of the rifling (G1) is 7.95 mm (0.313") and at the distance H2 and F (G) is 8.301 mm (0.327"). The angle of the transition between H2 and G1 (α1) is 90°. The distance between H2 and G1 (h) is 0.34 mm (0.013"). The length between the cylindrical transition plus the neck bevel (s) is 2.00 mm (0.079"). The half angle of the slope at the transition of the rifling (i) is 1.5°.

The bore diameter of the barrel (F) is 7.62 mm (0.300") and the groove diameter of the barrel (Z) is 7.92 mm (0.312").

The maximum breech clearance (Fe) of the cartridge according to the invention in the cartridge chamber according to the invention is defined as 0.10 mm (0.004").

The breech clearance of 0.10 mm (0.004") is the maximum permissible breach clearance for centerfire rifle cartridges having a maximum permissible average gas pressure ($P_{max}$) of greater than 3800 bar (55115 psi) according to C.I.P. When the 7.62 mm×39 (M43) cartridge is loaded into the cartridge chamber according to the invention, the maximum breech clearance (Fe) is the legally defined maximum breech clearance (Fe) of 0.15 mm (0.006"), permissible for centerfire rifle cartridges at a maximum permissible average gas pressure ($P_{max}$) of up to 3800 bar (55115 psi). The design of the different respective maximum breech clearances for the cartridges according to the invention and the 7.62 mm×39 (M43) cartridge is unique and contributes to the maximal functional reliability of the firearm, even under adverse conditions.

FIG. 3 shows a section view through the longitudinal center axis of the cartridge 1, not to scale, of a combination of a breech and cartridge chamber according to the invention of a firearm. The cartridge 1 may be implemented as shown in FIG. 1 and the cartridge chamber 10 may be implemented as shown in FIG. 2.

The breech clearance (Fe), that is, the spacing between the case bottom of the cartridge and the closed breech of the firearm, is between 0.00 mm (0.00") and 0.15 mm (0.006") according to the invention.

Furthermore, FIG. 4 shows a schematic view of a potential firearm 12. Said firearm may be implemented as a support weapon, such as a machine gun, and may comprise the subject-matter of FIG. 3.

FIG. 7 shows a technical section view of a cartridge according to the invention inserted in the cartridge chamber according to the invention (top of drawing) and a cartridge of caliber 7.62×39 (M43) (bottom of drawing). From the top depiction, it is evident that the contours of the cartridge 1 according to the invention are closely fit into the cartridge chamber 10 according to the invention (see Detail E), that is, the outer contour thereof fits snugly in the complementary internal contour of the cartridge chamber 10, and comprises a breech clearance (Fe) of 0.10 mm (0.004") (see Detail I).

From the bottom depiction and Detail F, it is evident that the 7.62 mm×39 (M43) cartridge also can be loaded into and fired from the cartridge chamber according to the invention while maintaining the precisely defined breech clearance of 0.15 mm (0.006") here. This is particularly due to the contractive design for backward compatibility according to the invention.

The cartridge according to the invention is superior to the known cartridges indicated above due to the significantly higher effectiveness thereof in the ultrasonic range, in conjunction with the unilateral backward compatibility of the associated cartridge chamber with the 7.62 mm×39 (M43) cartridge subject to the common maximum performance parameters and the capability to fire projectiles in the subsonic range. The previously present gap in capability can thus be closed by the subject-matter according to the invention. The cartridge according to the invention and a firearm according to the invention having the cartridge chamber according to the invention enable better staying power and survivability with a significant increase in operational tactical options, and contribute to surviving complex and extreme firefights of the highest intensity in operations in the urban environment.

List of Reference Signs

1 Cartridge
2 Case bottom
3 Extractor groove
4 Case body
5 Shoulder cone
6 Case neck
7 Case mouth
8 Projectile
9 Cartridge space
10 Cartridge chamber
11 Breech
12 Firearm Cartridge Reference SIGNS L1 Length to shoulder cone
L2 Length to transition shoulder cone/case neck
L3 Case length
L6 Cartridge length/overall length
R Rim height
R1 Rim diameter
E1 Diameter of extractor groove
E Case bottom height
f Length of rim bevel
β Bevel angle on rim
δ Bevel angle of extractor groove
P1 Diameter at transition case body/extractor groove
P2 Diameter at transition shoulder cone/case neck
α Angle of shoulder cone
S Length to apex of shoulder cone angle
$r1_{min}$ Shoulder radius
r2 Neck radius
H1 Diameter at transition shoulder cone/neck
H2 Diameter at case mouth
G1 Projectile diameter at case mouth Cartridge Chamber Reference Signs L1 Length of the cartridge chamber up to diameter P2
L2 Length of the cartridge chamber up to diameter H1
L3 Length of the cartridge chamber up to diameter H2
R Distance from breech block to rear edge of the barrel
R1 Diameter of the breech block
E Distance from breech block to inlet of the cartridge chamber
P1 Diameter at inlet of the cartridge chamber or at distance E
P2 Diameter at the start of the shoulder cone at distance L1
α Angle of shoulder cone
S Length to apex of shoulder cone
$r1_{max}$ Radius of transition at end of diameter P2
r2 Radius of transition at case neck
H1 Diameter at start of case neck at distance L2
H2 Diameter at distance L3
G1 Diameter at start of transition of rifling
G Distance between H2 and F
i Half angle of slope at transition of rifling
F Bore diameter of the barrel
Z Groove diameter of the barrel

The invention claimed is:

1. A cartridge of a firearm comprising a cartridge case implemented in the manner of a bottleneck cartridge case for receiving a projectile, wherein the cartridge case has an overall length of 38.50 mm (1.5157") to 40.50 mm (1.5945"), wherein the length from the bottom to the transition from a shoulder cone to case neck is 32.29 mm (1.2713") to 33.29 mm (1.3106"), wherein the length of the case neck is selected such that the ratio of the diameter of the projectile to the case neck length of the cartridge case is between 1.26 and 1.36, and wherein the shoulder cone connects to the case neck and transitions into the case body of the cartridge case, wherein the case body connects to an extractor groove of the cartridge at the case bottom and has a conical taper from the extractor groove toward the shoulder cone, such that the case body has a diameter of 10.07 mm (0.3965") to 11.350 mm (0.4469") at the connection to the shoulder cone, and wherein the cartridge, when employed in weapons systems, demonstrates unilateral backward capability.

2. The cartridge according to claim 1, characterized in that the cartridge case is implemented as a rimless rifle cartridge having a centerfire primer.

3. The cartridge according to claim 1, characterized in that the diameter of the projectile is 7.85 mm (0.309") to 7.92 mm (0.312").

4. The cartridge according to claim 1, characterized in that the length of the case neck is 5.81 mm (0.2287") to 6.61 mm (0.2602").

5. The cartridge according to claim 1, characterized in that the maximum overall length of the cartridge is 55.00 mm (2.165") to 57.00 mm (2.244").

6. The cartridge according to claim 5, characterized in that the maximum overall length of the cartridge is 55.70 mm (2.1929") to 56.30 mm (2.165").

7. The cartridge according to claim 1, characterized in that the case body has a diameter (P1) of 11.35 mm (0.4469") at the connection to the extractor groove (3)).

8. The cartridge according to claim 1, characterized in that a radius ($r1_{min}$) of 1.50 mm (0.0591") is provided at the transition from the case body to the shoulder cone and a radius (r2) of 1.50 mm (0.0591") is provided at the transition from the shoulder cone to the case neck.

9. The cartridge according to claim 1, characterized in that the shoulder cone is implemented having a conical taper toward the case neck and a half angle of 20° to 42.5°.

10. The cartridge according to claim 9, characterized in that the shoulder cone is implemented having a conical taper toward the case neck and a half angle ($\alpha$) of 20° to 30°.

11. The cartridge according to claim 1, wherein the cartridge case has an overall length of 38.50 mm (1.5157") to 39.50 mm (1.5551"), and the length of the case neck is selected such that the ratio of the diameter of the projectile to the case neck length of the cartridge case is between 1.26 and 1.27.

12. The cartridge according to claim 1, wherein the length from the bottom to the transition from shoulder cone to case neck is 32.79 mm (1.2090").

13. The cartridge according to claim 7, characterized in that the case body has a diameter of 10.45 mm (0.4114") to 11.00 mm (0.4331") at the connection to the shoulder cone.

14. A cartridge chamber of a firearm, wherein the cartridge chamber has a cartridge space comprising a case neck to which a shoulder cone connects and transitions into the case body of the cartridge space, wherein the cartridge space is implemented complementarily for receiving a cartridge according to claim 1.

15. The cartridge chamber according to claim 14, characterized in that the length of the cartridge chamber up to the diameter H2 is 38.50 mm (1.5157") to 40.80 mm (1.6063"), and the difference between the overall length and the length from the bottom to the transition from a shoulder cone to case neck of the cartridge chamber is selected such that the ratio of the diameter of the projectile transition to the difference between the overall length and the length from the bottom to the transition from a shoulder cone to case neck is 1.13 to 1.27.

16. The cartridge chamber according to claim 14, characterized in that the cartridge chamber is implemented having shoulder contact, so that the shoulder cone of a cartridge inserted into the cartridge chamber contacts the complementary shoulder cone of the cartridge chamber.

17. The cartridge chamber according to claim 16, characterized in that the diameter of the case neck is 8.64 mm (0.3402"), and the cartridge space has a radius ($r1_{max}$) of 1.00 mm (0.0394") at the transition from the case body to the shoulder cone and a radius (r2) of 2.00 mm (0.0787") at the transition from the shoulder cone to the case neck.

18. A combination of a breech and a cartridge chamber of a firearm comprising a cartridge chamber according to claim 14, characterized in that the cartridge chamber is implemented such that a breech clearance, that is the spacing between the case bottom of the cartridge and the closed breech of the firearm, is 0.00 mm (0.000") to 0.15 mm (0.006") for the cartridge.

19. The combination according to claim 18, characterized in that the cartridge chamber is capable of receiving a cartridge (1) of caliber 7.62 mm×39 (M43), wherein the breech clearance is between 0.00 mm (0.000") and 0.15 mm (0.006").

20. A firearm comprising a cartridge chamber according to claim 14 or a combination of a breech and the cartridge chamber, wherein the firearm is preferably a handgun, a small arm, such as a sidearm, a submachine gun, or a machine gun, or a combination thereof.

* * * * *